US005312011A

United States Patent [19]

Fischer

[11] Patent Number: 5,312,011

[45] Date of Patent: May 17, 1994

[54] STACKABLE CONTAINER SYSTEM

[75] Inventor: Dan E. Fischer, Sandy, Utah

[73] Assignee: Ultradent Products, Inc., South Jordan, Utah

[21] Appl. No.: 930,018

[22] Filed: Aug. 13, 1992

[51] Int. Cl.[5] ..... B65D 90/00

[52] U.S. Cl. ..... 220/528; 220/529; 220/306; 220/375; 206/508; 206/509

[58] Field of Search ..... 220/4.27, 23.6, 23.83, 220/380, 529, 532, 542, 541, 375, 528, 306; 206/509, 511, 508

[56] References Cited

U.S. PATENT DOCUMENTS

| | | | |
|---|---|---|---|
| D. 224,554 | 8/1972 | Sweet | 220/529 X |
| 2,412,325 | 12/1946 | Devine et al. | 220/23.83 X |
| 2,564,834 | 8/1951 | Devine et al. | 206/508 X |
| 2,645,375 | 7/1953 | Topfer . | |
| 2,663,450 | 12/1953 | Bourcart | 220/4.27 X |
| 2,940,589 | 6/1960 | Silverman | 206/5 |
| 2,978,142 | 4/1961 | Novick | 206/508 X |
| 3,001,564 | 9/1961 | Hopkins | 206/509 X |
| 3,369,691 | 2/1968 | Wei . | |
| 3,409,123 | 11/1968 | McCormick | 220/380 X |
| 3,458,078 | 7/1969 | Skidmore | 220/529 |
| 3,485,416 | 12/1969 | Fohrman | 220/4.27 X |
| 3,623,634 | 11/1971 | Norgard . | |
| 3,812,997 | 5/1974 | McNally | 220/529 |
| 3,954,178 | 5/1976 | Mason, Jr. | 206/509 X |
| 4,301,942 | 11/1981 | Kupperman et al. | 220/532 X |
| 4,386,701 | 6/1983 | Galer | 206/509 |
| 4,420,093 | 12/1983 | Von Holdt | 206/509 X |
| 4,429,786 | 2/1984 | Hucal | 206/5.1 |
| 4,444,324 | 4/1984 | Grenell | 215/6 |
| 4,598,332 | 7/1986 | Alonso | 215/6 |
| 5,065,923 | 11/1991 | Hoefer et al. | 220/529 X |

FOREIGN PATENT DOCUMENTS

| | | | |
|---|---|---|---|
| 0270698 | 2/1988 | European Pat. Off. | 206/528 |
| 2035539 | 1/1972 | Fed. Rep. of Germany | 220/23.6 |

*Primary Examiner*—Allan N. Shoap
*Assistant Examiner*—Nova Stucker
*Attorney, Agent, or Firm*—Workman Nydegger Jensen

[57] ABSTRACT

A stackable container system having a plurality of individual containers wherein each container is snapped onto and securely fastened to another similarly configured container. Each container has a lid securely tethered to the side of the container by an integrally molded strap such that the lids of the individual containers do not get lost or misplaced. The container lids are configured so as to securely engage the container sidewall by a snap-fit design having a conveniently placed thumb tab to facilitate the quick and easy release of the lid. A removable divider may be positioned within each container receptacle to compartmentalize the receptacle such that individual component parts can be stored in a single container and not become mixed or interspersed during storage. Each container of the stackable system may comprise a transparent material for the visual inspection of the contents contained therein prior to opening the container. The containers may be individually color coded so as to make for easier and quicker identification of any one container comprising the stackable system.

4 Claims, 4 Drawing Sheets

STACKABLE CONTAINER SYSTEM

BACKGROUND

1. Field of the Invention

The present invention relates to containers that are stackable, in particular, to a stackable container system wherein a plurality of similarly constructed containers are snapped together to form a stackable system of individual receptacles.

2. Background and Prior State of the Art

Stackable containers have been devised wherein one container can be stacked on top of the previous container and subsequently fastened together such that the stacked containers become interlocked. One way of achieving the fastening of one container to a second container has been by threading the bottom of one container to the top of the second container. Another way of fastening containers together involves a plurality of pins in one container which engage slots in a second container.

One problem with threading engagement or the use of pins to fasten containers together is that such container systems are costly to construct. Furthermore, the threading engagement or the use of pins in a container system increases the time required to engage and disengage the containers from each other. This can often be an annoyance.

Another problem is that when the containers are disengaged, one of the containers is subsequently without a lid. Contamination of the contents of a second or bottom container is thus difficult to avoid because the contents are temporarily unprotected.

Another problem with stackable container systems commonly found in the art is that in the systems where the individual containers each have a separate removable lid, the user may have opened several containers. As a result, because the individual receptacles have separate removable lids, there may be confusion as to which lid attaches to which container. In some instances, if the user replaces the wrong lid onto one of the individual receptacles, there may be some inadvertent contamination of the contents.

Also, where the lids are separately removable, there is the possibility that one or more lids belonging to the stackable system may be lost or misplaced. If one or more lids belonging to the stackable system are lost or misplaced, additional lids have to be obtained or the individual receptacle that is missing the lid may have to be discarded.

Stackable containers commonly found in the art are also often constructed such that a fixed number of receptacles are contained in the stackable system. Once the fixed number of containers within the stackable system have been filled, another complete container system must then be acquired because the system lacks the flexibility to add or remove one or more container receptacles to the stackable system.

Another difficulty which often arises with the use of the prior art type container systems stems from an inability to easily distinguish one container from another. When use is made of a plurality of such receptacles, it is often difficult to ascertain the contents of the individual receptacles without first opening them or taking the system of containers completely apart.

BRIEF SUMMARY AND OBJECTS OF THE INVENTION

The present invention seeks to overcome the above and other problems in the prior art. More specifically, it is a primary object of the present invention to provide a stackable container system wherein one container can be easily snapped on top of another container so as to be fastened thereto, and so as to permit the individual containers to be easily disconnected, and to be easily arranged or rearranged in any desired order.

It is another primary object of the present invention to provide a stackable container system wherein the system of containers is designed and constructed so as to enable the interconnecting of virtually any number of receptacles as desired.

It is an object of the present invention to provide a stackable container system wherein the individual receptacles comprising the stackable system have a removable divider that compartmentalizes the receptacle chamber such that the individual components stored therein do not become mixed or interspersed within the container.

It is an object of the present invention to provide a stackable container system wherein the receptacles in the stackable system each have an individually removable lid that is tethered to the container receptacle and which effects closure by a snap-fit, so that individual lids are not lost or placed on other containers, and so that reclosure is easily accomplished and contamination of contents eliminated where necessary.

It is yet another object of the present invention to provide a stackable container system wherein the individual receptacles of the system are constructed such that the contents of the receptacles can be visually inspected prior to opening the lid or removing the container from the system, and wherein the individual containers may also be color-coded to easily and quickly enable the identification and/or ordering of individual receptacles within the system.

It is still another object of the present invention to provide a stackable container system that is simple to construct and cost efficient to manufacture.

These and other objects and features of the present invention will become more fully apparent from the following description and appended claims taken in conjunction with the accompanying drawings, or may be learned by the practice of this invention.

Briefly summarized, the stackable container system of the present invention comprises a plurality of individual containers wherein each container is configured on its top and bottom such that any container can be snapped and securely fastened to the top of any other container, and yet can be also easily disengaged by unsnapping the individual receptacles from the stackable system. Each container of the stackable system has a lid hinged to the side of the receptacle wall by an integrally molded strap such that the lids of the individual containers do not get lost or misplaced. The container lids are configured so as to sealingly enclose the receptacle by a snap-fit design having a conveniently placed thumb tab to facilitate the quick and easy release of the lid from the receptacle. A removable divider may be positioned within each container receptacle to compartmentalize the receptacle such that individual component parts can be stored in a single container and not become mixed or interspersed during storage. Each container of the stackable system may comprise a transparent material for the visual inspection of the contents contained therein prior to opening the container. The containers may also be individually color coded so as to make for easier and quicker identification of any one container in the stackable system.

BRIEF DESCRIPTION OF THE DRAWINGS

In order to more fully understand the manner in which the above-recited advantages and objects of the present invention are obtained, a more particular description of the invention will be rendered by reference to specific embodiments thereof which are illustrated in the appended drawings. Understanding that these drawings depict only one or more embodiments of the invention and are therefore not to be considered limitations in the scope of the invention, the presently preferred embodiments and the presently understood best mode of the invention will be described with additional detail through use of the accompanying drawings in which.

DETAILED DESCRIPTION OF THE PREFERRED EMBODIMENTS

Reference is now made to the drawings wherein like parts are designated with like numerals throughout.

Figure 1:
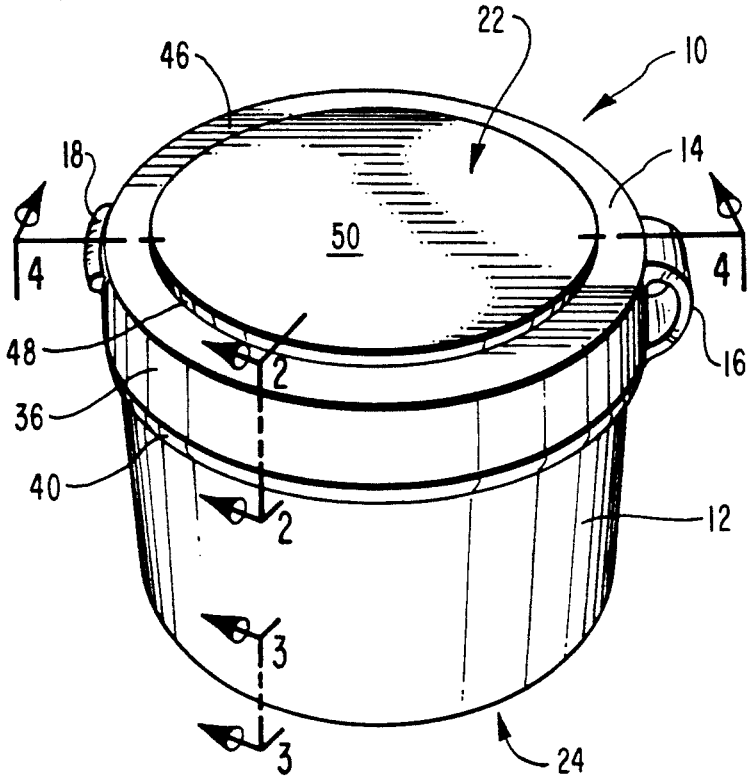
FIG. 1 is a perspective view of one embodiment of the stackable container system of the present invention illustrating a single container having a closed lid that is tethered or hinged to the sidewall of the container receptacle.

FIG. 1 illustrates a single container of the stackable system, generally designated at 10, with a top section 22 and a bottom section generally designated at 24, which together form a receptacle. At the top section generally designated at 22, a lid 14, shown in the closed position, is securely affixed and attached to the sidewall 12 of the bottom section 22 of the receptacle. In the embodiment illustrated, the container 10 is substantially cylindrical in shape. The bottom section 22 is slightly tapered from the lid 14 to the base of the receptacle. Other container configurations such as substantially rectangular or polygonal shapes could be used.

The container 10 of the present invention perferrably comprises a means for snapping the lid 14 onto the top of the receptacle sidewall 12 without the use of threads. With reference in FIG. 2 to the enlarged cross-section of the container 10 taken along line 2—2 of FIG. 1, such means is illustrated by way of example as comprising a snap-fit arrangement between the top of receptacle sidewall 12 and the rim 36 of the lid 14. The snap-fit engagement between the lid 14 and the sidewall top 32 is achieved by the complementary fit of the annular ridge 34, which radially protrudes from around the inner surface of the rim 36 of the lid 14, and the annular depression 30 fashioned around the sidewall top 32. Such a configuration enables the lid of the individual container to securely engage the sidewall 12 of the receptacle by a snap-fit. This permits a quick and easy way of opening and closing the receptacle.

Protruding radially out from the receptacle sidewall 32 is an annular shoulder 40 that has a flat shoulder surface 38 upon which the rim 36 of lid 14 rests when the lid is in the closed position. The configuration of the annular shoulder 40 provides an effective stop for the lid 14 when snapped into place to close the receptacle. It is important that the lid 14 snap-fit with the top of receptacle sidewall 32 in a secure fashion in order to provide protection against contamination for some applications, and secure closure.

In the preferred embodiment, the entire container 10 is integrally molded from a sturdy resilient plastic material, such as a polypropelene polyethylene blend which is lightweight and cost effective. However, the use of other plastic materials commonly found in the art is contemplated and within the scope of the present invention.

Preferably, the material of container 10 is transparent so that the contents of the individual containers 10 can be visually inspected without opening them. In addition, the material of the individual containers 10 should be receptive to coloring in order to provide a way by which the containers 10 can be identified within the stackable system.

The preferred embodiment of container 10 further comprises a means for attaching the lid 14 to the sidewall 12 of the receptacle. In the preferred embodiment, the lid 14 is securely tethered or hinged to the sidewall 12 of the receptacle by a flexible strap member 16. Thus, the loss of the individual lids 14 or the inadvertent mixing of receptacles and lids is eliminated. In the preferred embodiment, the strap 16 is integrally molded at one end with the rim 36 of lid 14 and, at the other end, with the annular shoulder 40 just below the flat shoulder surface 38 on sidewall 12 of the receptacle.

The container 10 further preferrably comprises a means for facilitating the disengagement of the lid 14 from a secure attachment to the sidewall of the receptacle. In the present embodiment, the container 10 comprises a thumb tab 18 that facilitates the unfastening of the container lid 14 from the snap-fit engagement of the lid 14 to the top 32 of sidewall 12. In the preferred embodiment, the thumb tab 18 is integrally molded with the rim 36 of the lid 14 and is placed opposite to the point of attachment of the strap 16. The thumb tab 18 protrudes outward from the rim 36 of the lid 14 to form a convenient finger tab with which the lid 14 can be lifted.

Figure 2:
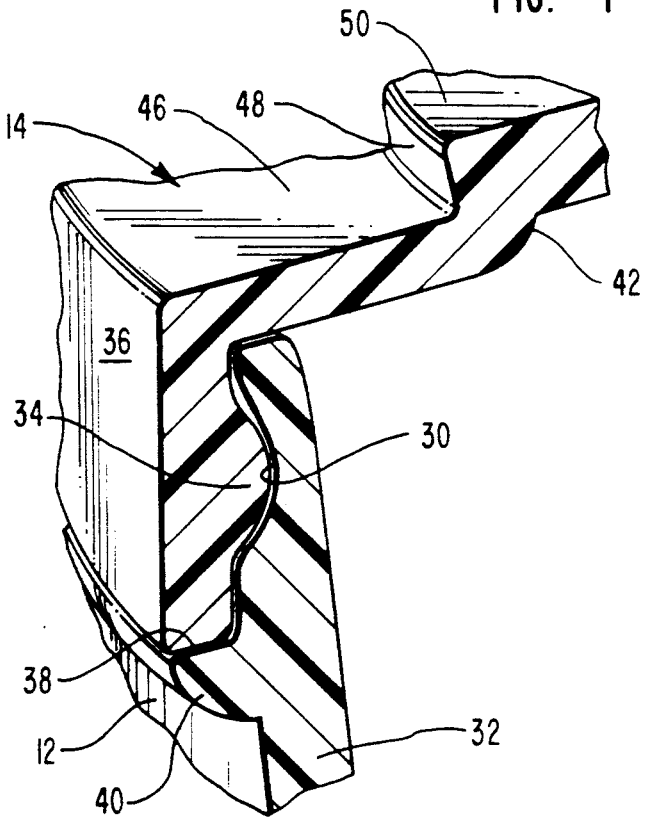
FIG. 2 is an enlarged cross-section of the embodiment of FIG. 1 taken along line 2—2 illustrating the snap-fit between the sidewall of the receptacle and the container lid, and the male portion of the lid which snaps into and engages the bottom of the next container in the stackable system.

With continuing reference to FIG. 2, the stackable container system of the present invention advantageously permits individual containers 10 to be stacked together by means for snapping one container onto another using a pressure or snap-fit attachment. By way of example, at the top section 22 the lid 14 comprises a flat region 46 extending circumferentially around the lid 14 and abutting a lid shelf 48 which extends upwardly from the flat region 46 forming a male section, designated as 50, protruding from the surface of the lid.

Figure 3:
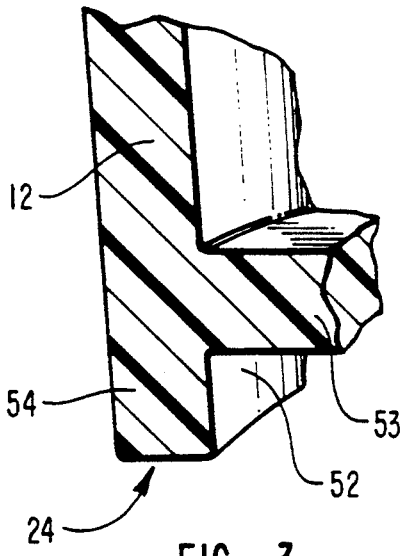
FIG. 3 is an enlarged cross-section of the embodiment of FIG. 1 taken along line 3—3 illustrating the underside of the container, which forms the female portion into which the male portion of the lid of another container may be snapped and secured.
Figure 4:
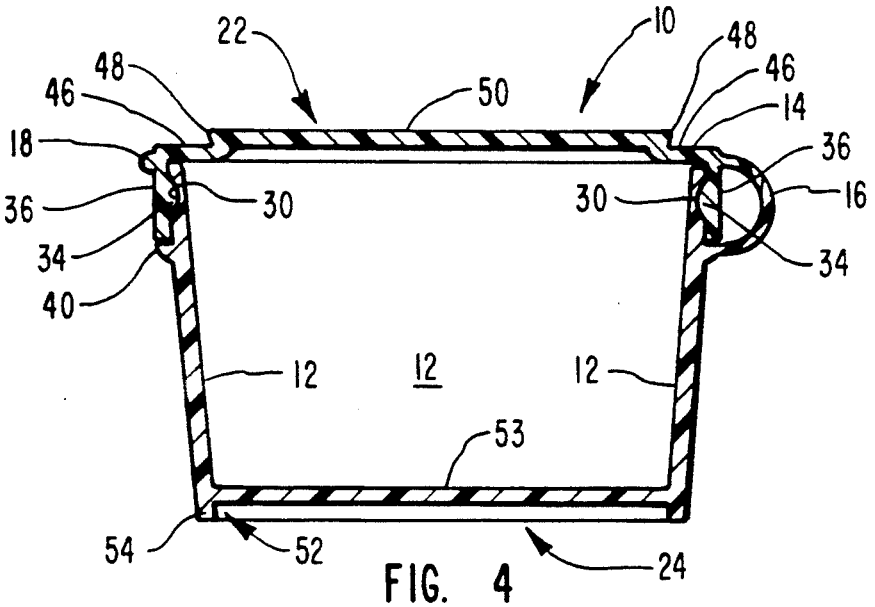
FIG. 4 is a cross-sectional view of the embodiment of FIG. 1 taken along line 4—4.

Reference is next made to FIG. 3, which is an enlarged cross-section of the embodiment of FIG. 1 taken along line 3—3 so as to illustrate the underside of the container 10. At the bottom section 24 of the receptacle 14, the lower sidewall 54 of the receptacle sidewall 12 extends past the receptacle bottom 53 to form a female section or cavity, designated as 52. The pressure or snap-fit is achieved by the slight oversizing of the male section 50 with respect to the female cavity 52. FIG. 4 is a cross-sectional view of the embodiment of FIG. 1 taken along line 4—4 illustrating the protruding male section 50 at the top of container 10 and the female cavity 52 at the underside or bottom of container 10.

Figure 5:
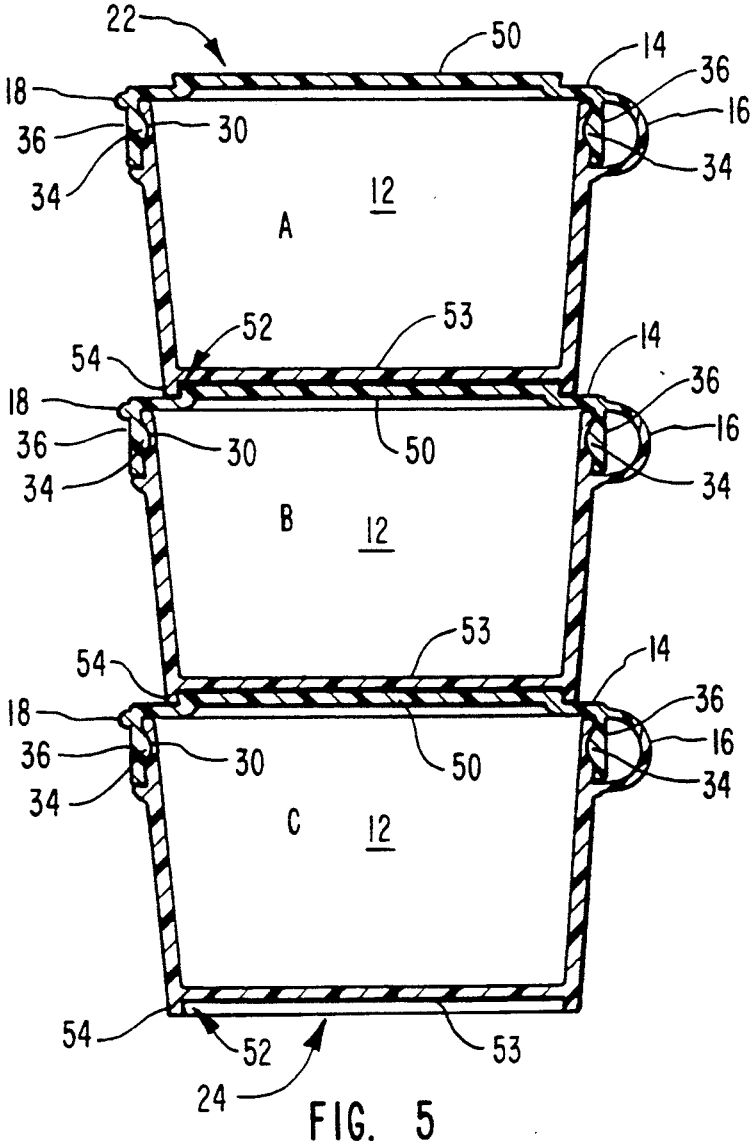
FIG. 5 is a cross-sectional view of one embodiment of the present invention wherein a plurality of individual containers are snapped together so as to form a plurality of stacked containers that are secured to one another.

With reference being made next to FIG. 5, by the repeated interconnection of the underside female cavity 52 located at the bottom section 24 of the container 10 with the male section 50 located at the top side 22, a plurality of individual containers 10 can be stacked together. As illustrated in FIG. 5, the bottom of container "A" snaps to the top of container "B" by a male/-female pressure fit. In a similar fashion, the bottom of container "B" snaps to the top of container "C". With such a novel pressure fit design, the plurality of interconnected individual containers 10 forms the stackable system wherein the containers are secured together, but can be arranged in any order using any number of containers.

Figure 8:
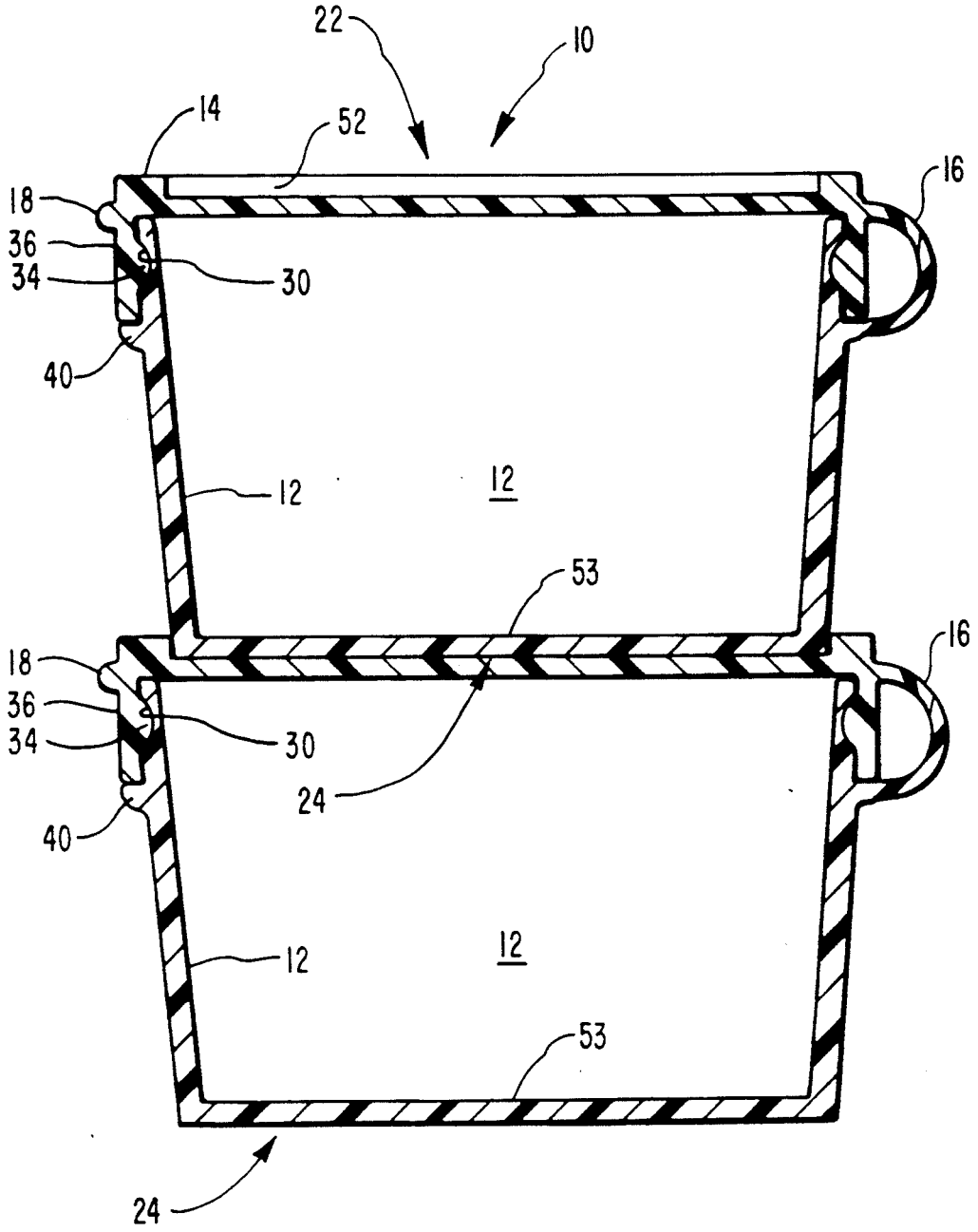
FIG. 8 is a cross-sectional view of another embodiment of the present invention wherein the male portion is provided by the underside of the receptacle and the female portion is configured on the top side of the container lid.

In the embodiments of the individual containers illustrated in FIGS. 1–5, the female portion of the pressure fit configuration is on the bottom of the container while the male section is positioned on the top section of the container lid. In the alternative, the individual containers comprising the stackable container system of the present invention can be configured as shown in FIG. 8, which is a cross-sectional view of a container wherein the male portion is provided by the underside 53 of the receptacle and the female portion, designated at 52, is on the top section 24 of the lid 14. In this alternative configuration, the bottom section of one container still snaps to the top section of the following container in the stackable system by a pressure or snap-fit.

It is to be understood and appreciated that the function of the snap-fit or pressure fit configurations illustrated in FIGS. 1–5 and 8 could be provided by a variety of different designs, and such variations are therefore intended to be within the scope of the invention as broadly described and claimed herein.

Figure 6:
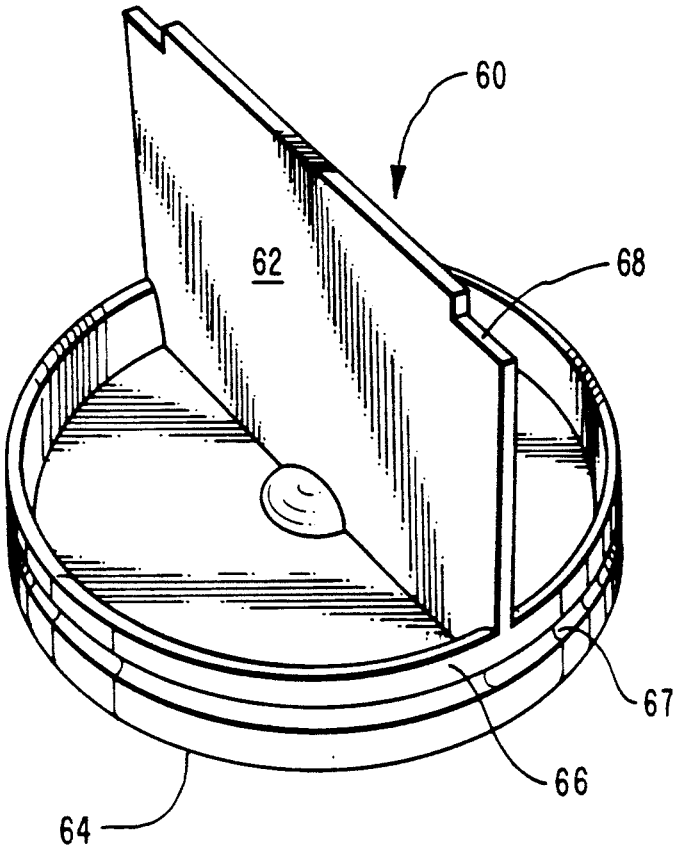
FIG. 6 is a perspective view of another embodiment of the present invention wherein the individual receptacles of each container are compartmentalized by a removable divider inserted into the container.
Figure 7:
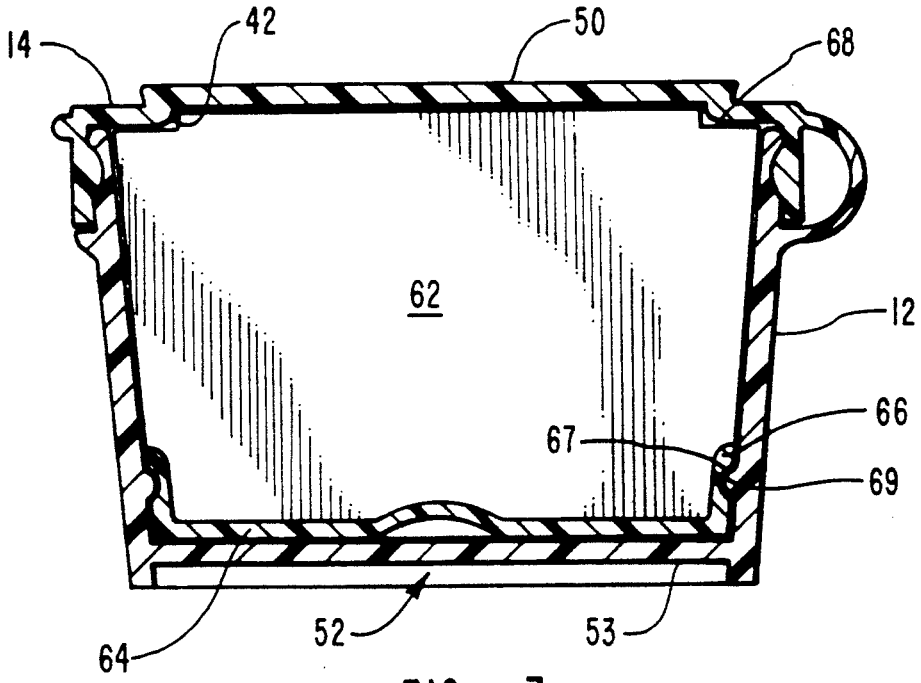
FIG. 7 is a cross-section showing the interior divider of FIG. 6 located within a container.

With reference to FIGS. 6–7, in order to compartmentalize the individual receptacles of each container 10, the present invention may advantageously further comprise a tray 60 having a divider wall 62 integrally molded to a circular bottom 64 with a circumferential lip 66. The divider wall 62 has corners 68 that are cut out of the tray such that the tray 60, once inserted into the container receptacle 14 of FIG. 1, will fit into the region, designated as 42 in FIG. 2, formed by the underside of the shelf wall 48 and the flat region 46 of the lid 14. The corners 68 enable the divider wall 62 of the tray 60 to fully compartmentalize the receptacle of the container for the storage of two distinct components in the same container without mixing the contents.

The circular bottom 64 is provided with an annular groove 67 as shown which receives in a snap fit a corresponding annular ridge 67 that is formed on the sidewall of the receptacle near the bottom thereof so that the circular bottom 64 can fit into the receptacle in a snap-fit manner, all is illustrated in FIGS. 6 and 7 taken together.

The present invention may be embodied in other specific forms without departing from the spirit of this invention or its essential characteristics. The described embodiments are to be considered, in all respects, as illustrative and not restrictive. The scope of the invention is, therefore, indicated by the appended claims rather than by the foregoing description. All changes which come within the meaning and range of equivalency of the foregoing claims are to be embraced within their scope.

What is claimed and desired to be secured by United States Letters Patent is:

1. In a stackable container system wherein a plurality of containers are securable one to the other when stacked together, each said container comprising:

a generally cylindrical receptacle having an open top, a bottom and at least one sidewall, in which to store items:

a generally circular lid for selectively opening and closing the top of said receptacle, said lid comprising means for engaging said at lest one sidewall in a snap-fit engagement;

means for tethering the lid to the receptacle to provide permanent attachment thereto;

selectively removable means for dividing the interior of said receptacle into at least two separate compartments that are simultaneously accessible and visible, the selectively removable means comprising a substantially cylindrical base member conforming in shape to the cylindrical shape of the receptacle, the base member having a vertical divider wall attached thereto, and the base member with attached vertical divider wall fitting into the cylindrical receptacle, and the base member having means for securing the base member on top of the receptacle bottom with a snap-fit;

a male snap-fit member formed on one of either said lid and the bottom of the receptacle, and a female snap-fit member formed on the other of the lid and the bottom of the receptacle, such that each pair of containers can be stacked together by attachment of a male snap-fit member of one container to a female snap-fit member of another container; and wherein the receptacle, lid, tethering means and the male and female snap-fit members are comprised of a single, integral molded material and wherein each said container is formed of material that is sufficiently transparent to permit visual inspection of the items without removing the lid and wherein a plurality of said containers are formed from material of differing colors.

2. A stackable container system as defined in claim 1, wherein said male member comprises a generally circular shelf, and said female member comprises a corresponding circular cavity.

3. A stackable container system as defined in claim 2, wherein said circular shelf is formed on said lid, and said circular cavity is formed on the bottom of said receptacle.

4. A stackable container system as defined in claim 2, wherein said circular shelf is formed on the bottom of said receptacle, and said circular cavity is formed on said lid.

* * * * *

UNITED STATES PATENT AND TRADEMARK OFFICE

CERTIFICATE OF CORRECTION

PATENT NO. : 5,312,011

DATED : May 17, 1994

INVENTOR(S) : DAN E. FISCHER

It is certified that error appears in the above-indentified patent and that said Letters Patent is hereby corrected as shown below:

Column 2, line 66, after "and" insert --do--
Column 4, line 3, "perferrably" should be --preferably--
Column 6, line 6, "is" should be --as--
Column 6, line 25, ":" should be --;--
Column 6, line 28, "lest" should be --least--

Signed and Sealed this

Eleventh Day of October, 1994

*Attest:*

*Attesting Officer*

Bruce Lehman

BRUCE LEHMAN

*Commissioner of Patents and Trademarks*